United States Patent [19]

Brownlee

[11] 4,076,359

[45] Feb. 28, 1978

[54] LAMP SOCKET ASSEMBLY AFFORDING VARIABLE BULB FOCAL LENGTH POSITIONING

[75] Inventor: Robert Charles Brownlee, Fenton, Mich.

[73] Assignee: Chrysler Corporation, Highland Park, Mich.

[21] Appl. No.: 778,803

[22] Filed: Mar. 17, 1977

[51] Int. Cl.[2] ..... H01R 33/46; F21V 19/02

[52] U.S. Cl. ..... 339/32 R; 339/59 L; 339/188 R; 362/285

[58] Field of Search ..... 339/31, 32, 59 L, 91 L, 339/176 L, 177 L, 182 L, 189 L, 217 S, 220 L, 221 L, 188 R; 240/41 L, 44.2, 44.26

[56] References Cited

U.S. PATENT DOCUMENTS

| | | | |
|---|---|---|---|
| 1,150,552 | 8/1915 | Stearns | 240/44.2 |
| 2,158,852 | 5/1939 | Ceader | 339/59 L |

FOREIGN PATENT DOCUMENTS

| | | | |
|---|---|---|---|
| 570,285 | 1/1924 | France | 240/44.2 |

*Primary Examiner*—Neil Abrams
*Attorney, Agent, or Firm*—Baldwin & Newtson

[57] ABSTRACT

A socket assembly including a tubular metallic socket member for receiving the contacting base of an electrical lamp bulb and an external socket housing member receiving said socket member therein. The socket housing and socket members are internally and externally configured to afford a selection of several different focal lengths to which a lamp bulb may be positioned for use with different lamp housings.

8 Claims, 4 Drawing Figures

LAMP SOCKET ASSEMBLY AFFORDING VARIABLE BULB FOCAL LENGTH POSITIONING

BACKGROUND OF THE INVENTION

Reference may be had to U.S. Pat. No. 3,873,176 for a showing of a vehicle lamp socket assembly having a plastic external body which receives metal tubes or sockets of different axial lengths in order to change the focal point of the lamp bulb relative to and for different focal length lamp housings in which the bulb and lamp socket assembly are to be supported.

SUMMARY

This invention relates to vehicle lamp sockets, and, more particularly, to a vehicle lamp socket assembly in which the same lamp socket member and socket housing member are employed to afford a selection of several different focal lengths or points to which a lamp bulb may be positioned for different focal length lamp housings.

Prior forms of vehicle lamp socket assemblies, as typified by the aforementioned patent, employ socket members of different lengths, thus requiring different socket assembly components for different focal length lamp housings with which the lamp socket assemblies are employed.

The present invention avoids the aforementioned objection and provides a vehicle lamp bulb socket assembly comprising a tubular metallic shell or barrel-shaped socket member and an outer body or socket housing member. The barrel body or socket housing member socket member features an axially longitudinally extending embossment terminating intermediately of the ends thereof and the socket housing has a plurality of arcuately spaced, longitudinally extending slots or grooves which are formed internally thereof and extend to different axial locations or depths therein to form differentially located stop abutments, whereby the same socket member and socket housing may accommodate and position a lamp bulb received in the socket member to any one of several different focal lengths or positions in accordance with the particular groove in which the embossment on the socket member is inserted in the socket housing.

DESCRIPTION OF THE PREFERRED EMBODIMENT

Figure 1:
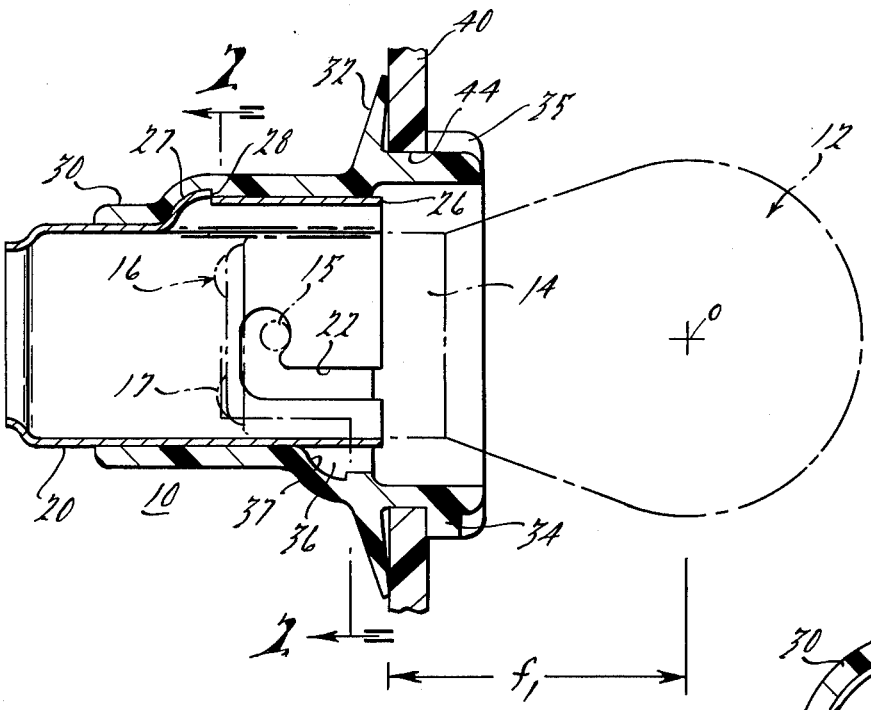
FIG. 1 is a longitudinal sectional elevational view of a lamp socket and housing assembly in accordance with the present invention in which the socket is inserted in the housing in such a manner as to position a lamp bulb to one focal length in a lighting device.
Figure 3:
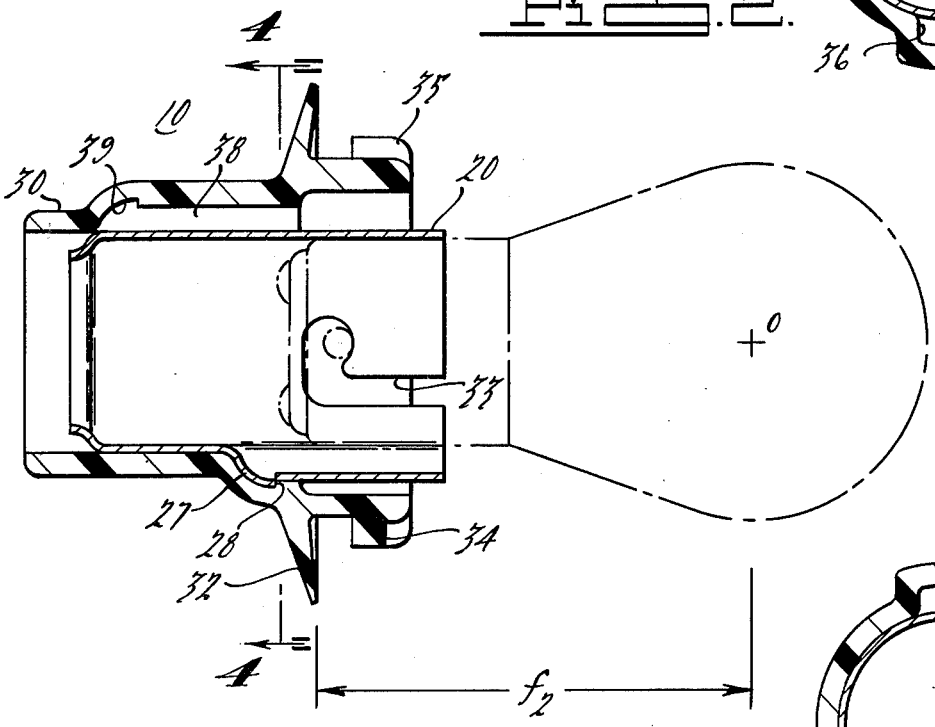
FIG. 3 is a longitudinal sectional elevational view of the lamp socket and housing assembly in which the socket is differentially positioned in the housing in such a manner as to position a lamp bulb to a different focal length for a different lighting device.

FIGS. 1 and 3 illustrate a bulb socket assembly 10 comprising a tubular metallic socket member 20, which receives the base 14 of the lamp bulb 12 and is received within the hollow interior of a plastic or metallic socket body or housing member 30. The bulb 12, shown in dotted outline, is an incandescent filament-type A, B or C based vehicle lamp bulb, as used for vehicle tail lamps and park/turn signal lamps, for example, and may be of the single or multiple filament variety with one or more electrical button contacts 16, 17 at the rear thereof. Electrical energy is supplied through the contacts to one side of the bulb filament or filaments through one or more electrical conductors (not shown), each terminating in a conventional terminal received within the housing 30 and insulated from each other and the housing for contacting a respective one of the buttons.

The barrel-shaped socket member 20 provides a bayonet mount for the bulb through a pair of oppositely disposed J-slots 22, 23 which may be of the odd or even variety and cooperate with the projecting pin 15 on the cylindrical base 14 constituting the grounding or electrical return terminal from the other side of the bulb filament or filaments.

The socket housing member 30 is of a generally, tubular walled formation, and, near its forward end, has an outwardly extending annular sealing collar or flange 32, which engages the back face of a panel 40 having an aperture 44 with one or more spaced cutouts therein as shown in the aforementioned patent referenced herein. Several arcuately spaced locking flanges, two of which are shown at 34, 35 herein and located at the forward end of the socket body 30, permit the forward end of the socket housing to be inserted into the cutouts in the similarly configured panel aperture and to be twisted or turned relative thereto to lock the socket against the opposite surfaces of the panel.

The panel 40 may define the back of a lamp housing lighting device in which the bulb socket assembly 10 is received and may be a flattened central portion of a rearwardly located parabolic reflector or the back wall of a lamp housing having a lens focusing system located forwardly of the lamp bulb. In either case, the bulb socket assembly must be positioned so that the bulb filament, shown at point O, is at the optical focal point of the parabolic reflecting surface or of the lens system. Thus, the protrusion of the bulb into the lighting device is a function of the bulb socket focal length.

In accordance with the present invention, the same socket member 20 and socket housing 30 are employed to provide a variable or multiple bulb socket focal length design, whereby a lamp bulb may be positioned to any one of several different focal lengths or points for several different lighting devices. To this end there is provided on the socket member 20 a longitudinally extending, ridged embossment 26, which is of a generally rectangular cross-section and terminates intermediate the ends of the member 20 to provide a stop surface 27 thereon.

Figure 2:
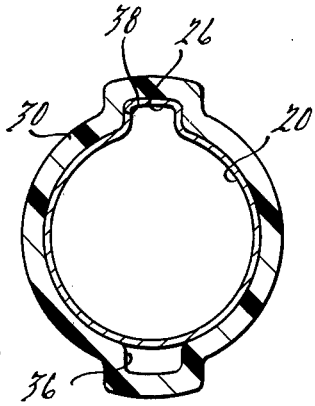
FIG. 2 is a transverse sectional view taken in the direction 2—2 of FIG. 2.
Figure 4:
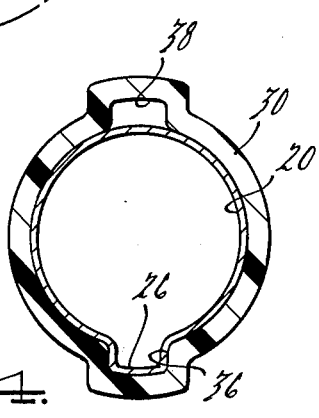
FIG. 4 is a transverse sectional view taken in the direction 4—4 of FIG. 3.

In addition, the socket housing member 30 is internally formed with several arcuately or angularly displaced slots or grooves 36, 38, which are of corresponding complementary shape to receive the socket embossment therein, but are of different longitudinal axial extents or depths therein. As shown in FIGS. 1 and 3, the slots terminate at different longitudinal axial locations within the socket housing to provide differentially longitudinally located stop surfaces 37, 39 to cooperate with the embossment stop surface 27 on the socket barrel member 20 which is snugly received within the interior of the housing member into which it is inserted from one end thereof. Depending on the socket focal length desired, the barrel is oriented and aligned or indexed with a selected one of the housing slots or grooves 36, 38 as shown in FIGS. 2 and 4 and is pressed into place. The selected focal length is set when the barrel bottoms out in the housing slot with the top surface 27 thereon positioned against the cooperating stop shoulder or surface formed by the inner end of the housing groove. Suitable retaining means, as a tab 28 struck outwardly of the embossment 26, may be provided to permit insertion but prevent withdrawal of the socket barrel 20 from the socket housing.

With the socket barrel 20 oriented or indexed to receive the embossment 26 thereon in the upper groove or slot 38 in the housing 30, as shown in FIG. 2, the lamp bulb 12 will be positioned to provide a shorter focal length $f_1$ for the lamp and socket assembly shown in FIG. 1, than the focal length $f_2$ illustrated in FIG. 3 in which the socket barrel 20 is inserted in the lower groove or slot 36 in the housing 30 as shown in FIG. 4.

It should be appreciated that the described variable bulb socket focal length design is not restricted to a two focal length concept. Depending on the shape of the barrel embossment and the housing slots, three or more focal lengths are possible from the same parts. Moreover, the invention is not limited to cylindrical base bulbs, the principle of the invention being applicable to bulbs of different shaped bases, including wedge base bulbs, and correspondingly shaped socket members.

What is claimed is:

1. A lamp socket assembly providing a selection of several distinct and different bulb socket focal lengths for filament-type lamp bulbs electrically energizable through terminals at the base thereof, said socket assembly comprising elongated lamp socket means for longitudinally slidably receiving the base of a lamp bulb inserted to a given depth at which it may be energized therein, a socket housing having a hollow interior for longitudinal slidable reception of said lamp socket means therein, said socket housing having several arcuately spaced and differentially axially longitudinally located, discontinuous stop shoulder means internally thereof each related to a different one of said bulb socket focal lengths, and said lamp socket means having an outwardly directed protuberance on an external surface thereof to form a positive unyieldable stop surface located intermediate its ends and selectively positionable against any one of said several stop shoulder means of said socket housing upon longitudinal slidable insertion of said lamp socket means into said socket housing, whereby the same socket housing and lamp socket means may accomodate and position a lamp bulb so received and inserted in said lamp socket means to any one of several different focal lengths in accordance with which stop shoulder means of said socket housing the stop surface on said lamp socket means is positioned against.

2. A lamp socket assembly in accordance with claim 1 wherein said lamp socket means is a tubular member adapted to be longitudinally slidably received from one end of said socket housing, said socket housing has at least two arcuately spaced, internally formed grooves therein extending longitudinally axially and terminating at different longitudinal locations of said housing to form said stop shoulder means therein, and said lamp socket barrel member has an outwardly directed ridged embossment thereon conforming generally in cross-section to the cross-sectional shape of said housing grooves and extending longitudinally to a point intermediate the ends thereof to form said stop surface thereon for selective cooperation with said differentially located stop shoulder means in said housing grooves depending upon in which housing groove said embossment is inserted.

3. A lamp socket assembly in accordance with claim 2 wherein said lamp socket member is press-fitted into and snugly received within the interior of said socket housing.

4. A lamp socket assembly in accordance with claim 2 wherein said lamp socket member includes fastening means thereon cooperating with said socket housing to secure said member against withdrawal from said socket housing.

5. A lamp socket assembly in accordance with claim 4, wherein said fastening means comprises an outwardly lanced tab integrally formed on said ridged embossment to engage the interior of said socket housing.

6. A lamp socket assembly in accordance with claim 2 for a bayonet-type cylindrical based lamp bulb and wherein said tubular member has a pair of J-shaped slots therein located on opposite sides thereof for reception and bayonet mounting of said lamp bulb.

7. A lamp socket assembly providing a selection of several different bulb socket focal lengths for filament-type lamp bulbs electrically energizable through terminals at the base thereof, said socket assembly comprising longitudinally extending, electrically conductive lamp socket means in the form of a tubular metallic barrel member for receiving the base of a lamp bulb therein, and a generally tubular, walled socket housing having a hollow interior for longitudinal reception of said lamp socket means therein and at least two arcuately spaced internally formed grooves extending longitudinally axially and terminating at different longitudinal locations of said housing to form a pair of differentially axially longitudinally located stop shoulder means internally thereof, said lamp socket barrel member having an outwardly directed ridged embossment thereon conforming generally in cross-section to the cross-sectional shape of said housing grooves and extending longitudinally to a point intermediate its ends to form a stop surface thereon for selective cooperation with either of said differentially located stop shoulder means provided by said housing grooves depending upon in which housing groove said embossment is inserted, whereby the same socket housing and lamp socket means may accomodate and position a lamp bulb received in said lamp socket means to any one of several different focal lengths.

8. A lamp socket assembly in accordance with claim 7 wherein said lamp socket barrel member includes integrally formed fastening means thereon cooperating with said socket housing to secure said barrel member against withdrawal from said socket housing.

* * * * *